United States Patent [19]

Akai

[11] 4,376,530

[45] Mar. 15, 1983

[54] APPARATUS FOR DIVIDING STACKED SHEETS AND FOR FEEDING OUT THE SAME

[75] Inventor: Naoto Akai, Nagaokakyo, Japan

[73] Assignee: Jujo Engineering Co., Ltd., Nagaokakyo, Japan

[21] Appl. No.: 217,246

[22] Filed: Dec. 17, 1980

[30] Foreign Application Priority Data

Dec. 21, 1979 [JP] Japan ..... 54-167194

[51] Int. Cl.[3] ..... B65H 3/52

[52] U.S. Cl. ..... 271/10; 271/121

[58] Field of Search ..... 271/104, 121, 124, 125, 271/122, 10

[56] References Cited

U.S. PATENT DOCUMENTS 4,085,929 4/1978 Tuchiya ..... 271/122

4,216,952 8/1980 McInerny ..... 271/122 X

*Primary Examiner*—Richard A. Schacher

*Attorney, Agent, or Firm*—Barnes, Kisselle, Raisch, Choate, Whittemore & Hulbert

[57] ABSTRACT

An automatic sheet feeding apparatus in which a stack of sheets is separated from each other and separated sheets are fed out one by one. The stacked sheets are fed to a friction roller by means of a feeding roller and they are divided by two belts differing in stretching force which are arranged to have butting contact with the friction roller.

4 Claims, 8 Drawing Figures

PRIOR ART

APPARATUS FOR DIVIDING STACKED SHEETS AND FOR FEEDING OUT THE SAME

BACKGROUND OF THE INVENTION

As an automatic sheet feeding apparatus, in which a stack of papers is separated and separated papers are fed out one by one, there is known an apparatus shown in FIG. 8.

In this apparatus, a plurality of stacked papers P are placed on a supporting plate, and a feed-in roller 1 and a friction roller 2 are rotated in a direction indicated by an arrow to feed the papers P toward a dividing belt 3. When the papers P arrive at a contact point of the dividing belt 3 and the friction roller 2, the lowermost paper is delivered out by the frictional force of the friction roller 2 because the delivering force of the friction roller 2 overcomes the retreating force of the dividing belt 3, but the second paper and upper papers are prevented from advancing by the dividing belt.

Namely, the friction roller and belt are arranged so that a relation of $\mu_R > \mu_B > \mu_p$ is established among the friction coefficient $\mu_R$ of the friction roller 2 to the paper, the friction coefficient $\mu_B$ of the dividing belt 3 to the paper and the friction coefficient $\mu_p$ of the papers to each other. By this arrangement, the lowermost paper alone is separated from the upper papers and fed out.

In this paper feeding apparatus, in order to enhance the dividing capacity in feeding a plurality of papers, it is necessary to increase the contact pressure between the dividing belt 3 and the friction roller 2. In this case, if thin papers being easy to be folded are fed, the top ends of papers are readily butted against the dividing belt and bent to cause a phenomenon of so-called paper jamming. If the contact pressure of the dividing belt 3 to the friction roller 2, is decreased, occurrence of paper jamming is prevented, but if a plurality of thick and hard papers are fed at one time, the dividing belt 3 rises from the surface of the friction roller 2 and the dividing capacity is reduced, with the result that two or more papers are sometimes fed at one time.

SUMMARY OF THE INVENTION

The present invention relates to an apparatus for dividing stacked sheets and for feeding out the sheets and more particularly relates to an apparatus in which a stack of sheets is separated from each other and the divided sheets are fed out one by one automatically toward a reading zone or printing zone in a facimile telegraphy, a copying machine, a printing machine or the like.

Any flexible sheets of material such as paper, card, etc. can be applied to the apparatus of the present invention.

It is a primary object of the present invention to provide an automatic sheet feeding apparatus in which stacked sheets can be fed out one by one separately in a stable condition irrespectively of the thickness and strength of the sheets.

The apparatus of the present invention is characterized in that two belts differing in the stretching force are arranged to have butting contact with a friction roller and the inclination angles of the respective belts to the friction roller are made different from each other, whereby the paper-dividing capacity is enhanced.

According to the present invention, two kinds of dividing belts differing in the inclination angle are contacted with the surface of the friction roller, and the loosely stretched first dividing belt and the tightly stretched second dividing belt are arranged along the paper feed-out direction. Therefore, when papers fed are thin papers of a low strength, only the lowermost paper is separated by the first dividing belt, and when papers fed are thick papers of a high strength, they are roughly divided stepwise by the first dividing belt and the lowermost paper of divided several papers is divided by the second dividing belt and fed out by the friction roller. Papers, irrespectively of the strength thereof, that is, either thin papers of a low strength or thick papers of a high strength, can smoothly be divided and fed out one by one assuredly.

DETAILED DESCRIPTION OF THE INVENTION

Figure 1:
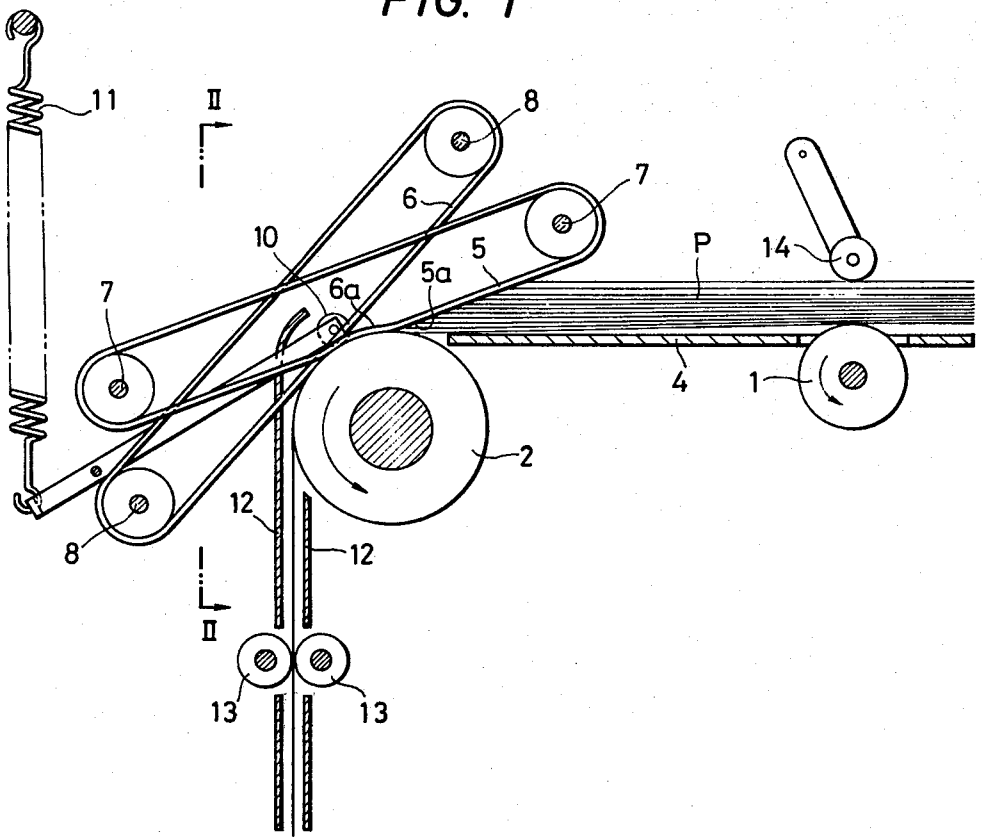
FIG. 1 is a sectional side view showing the structure of the apparatus of the present invention.

The present invention will now be described in detail with reference to embodiments illustrated in the drawings.

Figure 2:
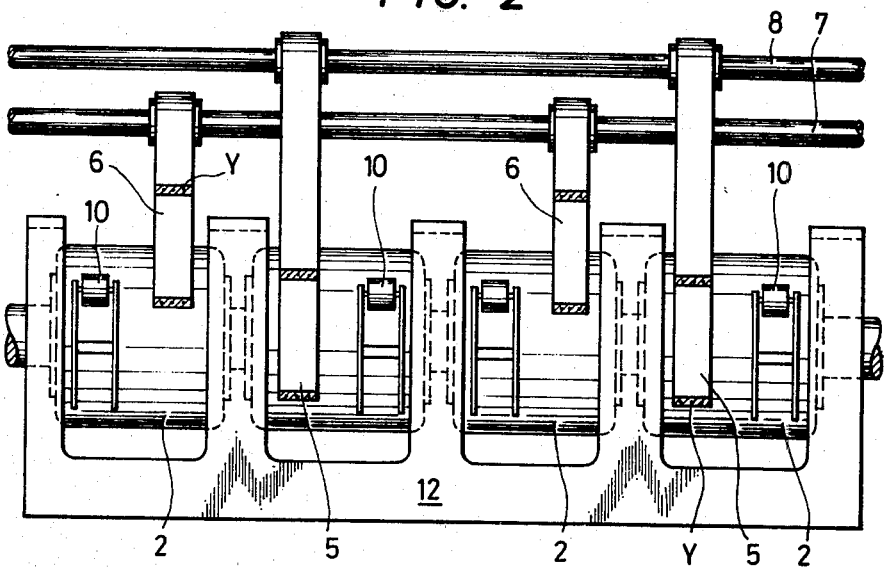
FIG. 2 is a view showing the section taken along the line II—II in FIG. 1.

Referring to FIGS. 1 and 2, a friction roller 2 is rotated in a direction indicated by an arrow, papers P stacked on a paper supporting plate 4 are fed to dividing belts 5 and 6 by a feed roller 1 and a pressing roller 14 for pressing papers by its own weight.

The first dividing belt 5 has a flat section and comprises a fiber core Y, and the second dividing belt 6 has a similar structure. The belts 5 and 6 are hung at a plurality of points on shafts 7 and shafts 8 so that they cannot be rotated. The first dividing belt is loosely stretched and arranged to have face-to-face contact with the peripheral surface of the friction roller 2, and the second dividing belt 6 is tightly stretched and arranged to have line-to-line contact with the peripheral surface of the friction roller 2.

The above-mentioned face-to-face contact and line-to-line contact are attained because each of the belts 5 and 6 has a certain width. In the plane of the side face as shown in FIG. 1, it may be said that the first dividing belt 5 has line-to-line contact and the second dividing belt 6 has point-to-point contact.

Figure 3:
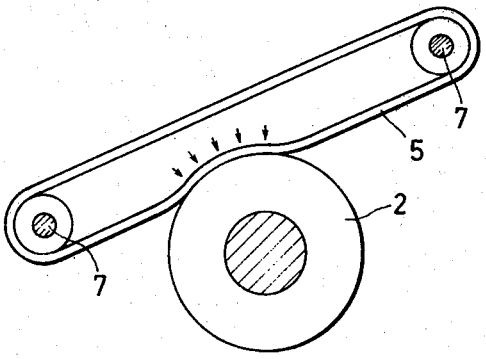
FIG. 3 is a side view showing the state of contact between the first dividing belt and the friction roller.

As illustrated above, the dividing belts 5 and 6 are stretched "loosely" and "tightly", respectively. By the term "loosely stretched" is meant the state where the belt 5 is pressed to and stretched on the surface of the friction roller 2 by the elasticity of the belt 5 per se as shown in FIG. 3, and the stretching force in this case is such that a paper of a low strength can be separated and passed through the belt and the tension imposed on the belt is zero.

Figure 4:
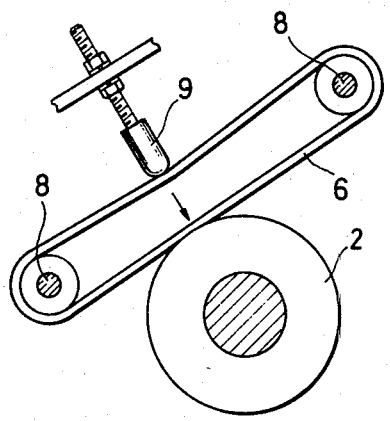
FIG. 4 is a side view showing the state of contact between the second dividing roller and the friction belt.

By the term "strongly stretched" is meant the state where a certain high tension is applied to the belt 6 by a tensioning device such as a screw rod 9 as shown in FIG. 4 and the belt 6 is contacted substantially tangentially with the surface of the friction roller 2, and the pressing force of the belt 6 to the surface of the roller 2 is zero and the stretching force is such that the elastic force is imposed by bending of the paper passing through the belt 6 and only one paper of a high strength is allowed to pass through the belt 6. Furthermore, there is formed a clearance allowing a paper of a low strength to pass therethrough, or even when the belt is contacted with the friction roller 2, the degree of contact is such that even a paper of a low strength introduced into the paper-catching portion between the belt and friction roller 2 is allowed to pass through the contact portion when the belt is bent on catching of the paper.

The contact position between the loosely stretched first dividing belt 5 and the second dividing belt 6 is arranged so that when the paper is divided and fed out, the first dividing belt 5 first acts on the paper and both the belts 5 and 6 fall in contact with each other at the point where the second dividing belt 6 then acts on the paper.

If a tightly stretched dividing belt is first arranged and a loosely stretched belt is subsequently arranged, a paper of a low strength butts against the strongly stretched dividing belt to cause paper jamming, and when a plurality of papers of a high strength are first introduced into the tightly stretched dividing belt, the belt is raised up and several lower papers pass through the belt without being divided, and in the subsequent belt loosely stretched, they are not divided but allowed to pass through the belt because the pressing force of the belt is small. Accordingly, it is important that as pointed out above, the loosely stretched first dividing belt is first arranged and the strongly stretched second dividing belt is subsequently arranged.

By the term "strength" is meant a resistant force against the folding or bending action caused when an external force is applied to a plain paper in the direction of the plane thereof. Ordinarily, thin papers have a low strength and thick papers have a high strength. Namely, the strength is judged based on the weight of 1000 papers having a unit area. In this case, the papers should be composed of the same material. Accordingly, for example, the strength of 1000 papers having an area of 1 $m^2$, which have a weight of 200 Kg, is higher than the strength of 1000 papers having an area of 1 $m^2$, which have a weight of 10 Kg. In short, the former papers have a higher strength and are less readily bent than the latter papers.

In the instant specification, the degree of the strength is one defined as above.

In the present embodiment, a pressing roller 10 is arranged in the vicinity of the contact point between the second dividing belt 6 and friction roller 2 so that an urging force directed to the center of the friction roller 2 is applied by a spring 11. More specifically, the driving force of the friction roller 2 is applied to the paper separated by the loosely stretched first dividing belt 5 by means of the pressing roller 10, and in case of a paper of a low strength, the strength is relatively intensified when the paper is introduced in the paper-catching portion of the tightly stretched second dividing belt 6 and friction roller 2, whereby passage of the paper through the belt is facilitated. By the expression "the strength is relatively intensified" is meant the state where the paper is pressed in the vicinity of the paper end by the pressing roller 10 and fed out to the second dividing belt so that when the paper is gripped at a point far from the paper end and the paper end portion is pressed, the paper is bent with a weak force and when the paper end portion is similarly pressed while gripping the paper at a point close to the paper end, the paper is bent with a strong force, whereby occurrence of paper jamming is prevented. Accordingly, it is preferred that the position of the pressing roller 10 be intermediate between the contact point between the tightly stretched second dividing belt 6 and the friction roller 2 and the contact point between the loosely stretched first dividing belt 5 and the friction roller 2 and be closer to the contact point of the second dividing belt 6 and the friction roller 2.

The function of the paper feeding apparatus having the above-mentioned structure will now be described.

When papers of a low strength are fed, stacked papers are delivered toward the paper-catching portion **5*a* of the friction roller 2 and first dividing belt 5 and since the first dividing belt 5 is loosely stretched, only the lowermost paper is separated from upper papers and fed by the friction roller 2, while the upper papers are prevented from advancing by the first dividing belt 5. One separated paper is delivered between the first dividing belt 5 and friction roller 2 in a direction indicated by an arrow and is fed to a catching portion 6*a* of the second dividing belt 6 and friction roller 2 while the paper is pressed to the surface of the friction roller 2 by the pressing roller 10. The second dividing belt 6 is tightly stretched and contacted substantially tangentially with the surface of the friction roller 2. Accordingly, when a paper of a low strength, that is, a thin paper, is passed, bending of the paper is reduced and also the pressure applied by the tension of the belt is reduced during the passage. Thus, papers of a low strength can be separated one by one assuredly by the dividing action of the first dividing belt 5**.

Figure 5:
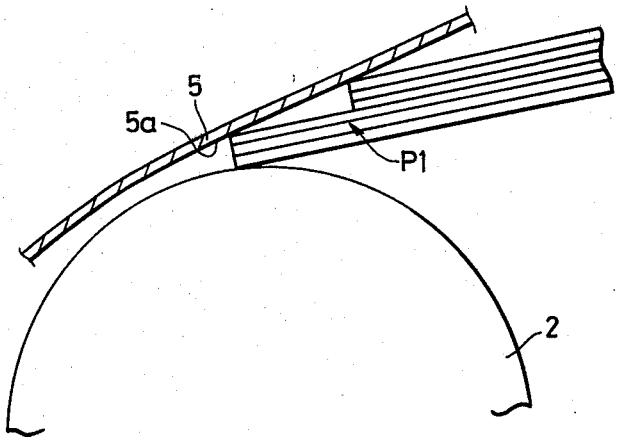
FIG. 5 is a diagram illustrating the state of first deviation of papers of a high strength.

When papers of a high strength are fed, since the stretching force of the first dividing belt 5 is small, separation of the papers is relatively difficult, and as shown in FIG. 5, a plurality (2 to 3) of papers P1 having a high strength are intruded into the catching portion in such a manner that the belt 5 is raised up and they are delivered in the stepwise stacked state without being divided.

Figure 6:
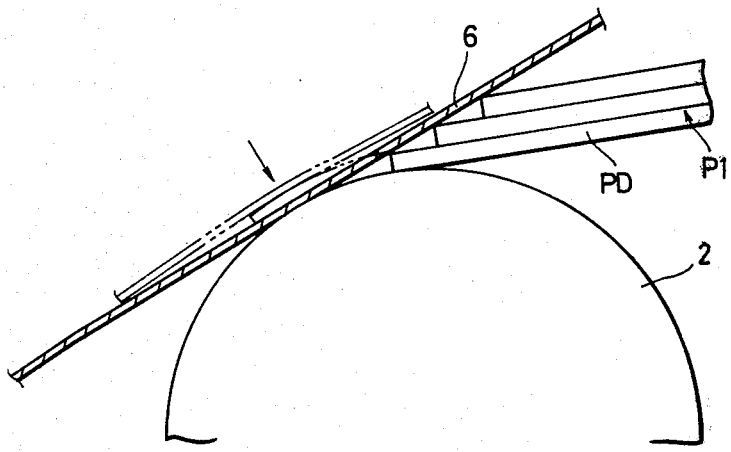
FIG. 6 is a diagram illustrating how upper papers of high strength are prevented from advancing while only the lowermost paper is separated.

The 2 or 3 papers which have passed through the first dividing belt 5 arrive at the contact point between the second dividing belt 6 and friction roller 2 in the stacked state. Since the stretching force of the second dividing belt 6 is large and the second dividing belt 6 is contacted substantially tangentially with the friction roller 2, when a plurality of papers of a high strength are fed, as shown in FIG. 6, the upper papers are prevented from advancing by the belt 6 while only the lowermost paper PD is separated and fed out by the friction roller 2. In this case, since the strength of papers is high, paper jamming is not caused in papers blocked by the strongly stretched belt 6 but the papers are kept stationary. Thus, these papers can be separated from the lowermost paper.

More specifically, papers of a high strength are appropriately drawn by the first dividing belt 5 and slipped out of the stacked state stepwise (this is called "first separation" hereinafter), and 2 to 3 papers stacked stepwise are divided by the second dividing roller 6 and only the lowermost paper is fed out by the friction roller 2 and dividing belt 6 (this is called "second separation" hereinafter). When many papers of a high strength are introduced to the tightly stretched second dividing belt, the belt is raised up by the paper and several lower papers among stacked papers are passed through the belt collectively. However, in the above-mentioned apparatus, such many papers of a high strength undergo the first separation and hence, only several papers are introduced in the stacked state and introduction of many papers of a high strength into the second dividing belt 6 is prevented. Accordingly, the papers of a high strength can be divided one by one by the second separation and then passed through the belt and fed to a predetermined position by a guide plate 12 and a feed roller 13.

Figure 7:
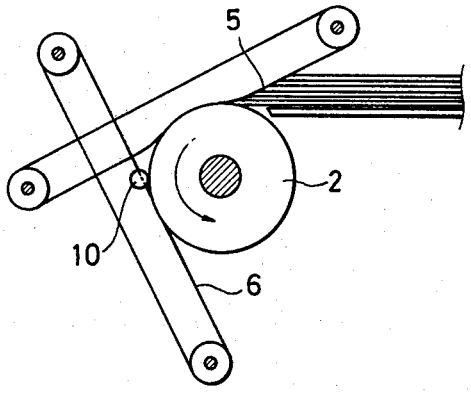
FIG. 7 is a side view showing the structure of another embodiment.
Figure 8:
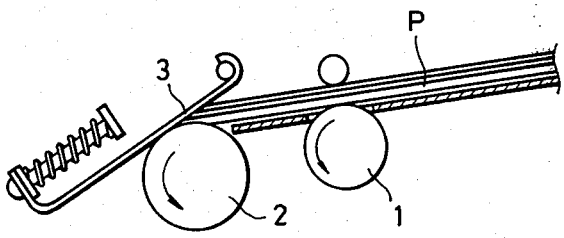
FIG. 8 is a side view showing the structure of the conventional apparatus.

FIG. 7 illustrates an embodiment in which the contact position of the second dividing belt 6 and friction roller 2 is changed from the contact position in the above-mentioned embodiment. Namely, the contact position may be any position where the paper passed through the first dividing belt 5 is passed through the second dividing belt 6 and fed out, and a position suitable to the apparatus to which the present invention is applied is selected. Of course, also in this embodiment, it is preferred that the pressing roller 10 be arranged in the vicinity of the paper-catching portion of the second dividing belt 6 and that a guide plate and a guide roller be disposed in an intermediate portion between the first dividing belt 5 and the second dividing belt 6 to deliver the papers.

What is claimed is:

1. An apparatus for dividing stacked sheets and for feeding out the sheet one by one comprising a feed roller which delivers stacked sheets, a friction roller rotating in the sheet-feeding direction, a loosely stretched first dividing belt arranged to have substantial face-to-face contact with the surface of the friction roller at the sheet-introducing side of the friction roller, said first dividing belt having substantially no tension applied thereto, and a tightly stretched second dividing belt arranged substantially tangentially to the surface of the friction roller and having a certain tension applied thereto, wherein sheets are passed between the first dividing belt and the friction roller and between the second dividing belt and the friction roller to be divided and fed out one by one separately.

2. An apparatus as claimed in claim 1, wherein the contact position of the friction roller with the loosely stretched first dividing belt and the tightly stretched second dividing belt is arranged so that the first dividing belt first acts on the stacked sheets and the second dividing belt subsequently acts on the sheets.

3. An apparatus as claimed in claim 1, wherein a pressing roller having an urging force applied by a spring and directed to the center of the friction roller is further provided on the friction roller between the contact point between second dividing belt and the friction roller and the contact point between the first dividing belt and the friction roller, and at a position closer to the contact point of the second dividing belt and the friction roller.

4. An apparatus as claimed in claim 2, wherein a pressing roller having an urging force applied by a spring and directed to the center of the friction roller is further provided on the friction roller between the contact point between second dividing belt and the friction roller and the contact point between the first dividing belt and the friction roller, and at a position closer to the contact point of the second dividing belt and the friction roller.

* * * * *